US006363670B1

(12) United States Patent
Dewitt

(10) Patent No.: US 6,363,670 B1
(45) Date of Patent: Apr. 2, 2002

(54) HURRICANE PROTECTION SYSTEM

(76) Inventor: William J. Dewitt, 1527 Cottonwood, Dunedin, FL (US) 34698

( * ) Notice: Subject to any disclaimer, the term of this patent is extended or adjusted under 35 U.S.C. 154(b) by 0 days.

(21) Appl. No.: 09/662,012

(22) Filed: Sep. 14, 2000

(51) Int. Cl.[7] ..... E06B 3/26

(52) U.S. Cl. ..... 52/202; 52/106; 52/107; 52/507; 52/203; 49/50; 49/57; 49/61; 49/62; 49/463; 49/465; 292/137; 292/165; 292/149

(58) Field of Search ..... 52/202, 106, 107, 52/507, 203; 49/50, 57, 61, 62, 463, 465; 292/137, 165, 149

(56) References Cited

U.S. PATENT DOCUMENTS 6,167,656 B1 * 1/2001 Devlin et al. ..... 52/202
6,219,978 B1 * 4/2001 Wood ..... 52/202

* cited by examiner

*Primary Examiner*—Carl D. Friedman
*Assistant Examiner*—Chi Nguyen

(57) ABSTRACT

A hurricane protection system comprises a rigid sheet in a rectangular configuration positioned within a window opening with an upper edge, a lower edge, and parallel side edges. A plurality of fixed retention mechanisms are secured to the sheet adjacent to the lower edge. Each fixed retention mechanism has a plate secured to the sheet and a downwardly extending finger with a lower end positioned in an associated hole and an upper end secured to the plate. A plurality of supplemental retention mechanisms are secured to the sheet adjacent to the upper and side edges. Each of the supplemental retention mechanisms include a J-shaped finger with a short leg and a long leg terminating in a free end reciprocal between a locked orientation within an associated hole and unlocked orientation out of, but aligned with, an associated hole. Each of the supplemental retention mechanisms include a bracket with a central face attached to the sheet. An inboard plate and an outboard plate extend at right angles from the central plate. The inboard and outboard plates have aligned apertures aligned with an associated hole for the reciprocal support of the long leg. The long leg has projections at an intermediate extent with a coil spring between the inboard plate and the projections urging the free end into an associated hole. The finger is adapted to be retracted from the hole against the urging of the spring and rotated whereby the short leg abuts the inboard plate to maintain the finger out its associated hole.

1 Claim, 3 Drawing Sheets

HURRICANE PROTECTION SYSTEM

BACKGROUND OF THE INVENTION

1. Field of the Invention

The present invention relates to a hurricane protection system and more particularly pertains to precluding damage to windows during high wind conditions.

2. Description of the Prior Art

The use of window covering devices of known designs and configurations is known in the prior art. More specifically, window covering devices of known designs and configurations previously devised and utilized for the purpose of protecting windows through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,831,319 to Warner discloses an awning-storm shutter and spring clip attachment means. U.S. Pat. No. 5,347,775 to Santos discloses hurricane shutters for windows. Lastly, U.S. Pat. No. 5,335,452 to Taylor discloses a hurricane panel apparatus.

While these devices fulfill their respective, particular objectives and requirements, the aforementioned patents do not describe a hurricane protection system that allows precluding damage to windows during high wind conditions.

In this respect, the hurricane protection system according to the present invention substantially departs from the conventional concepts and designs of the prior art, and in doing so provides an apparatus primarily developed for the purpose of precluding damage to windows during high wind conditions.

Therefore, it can be appreciated that there exists a continuing need for a new and improved hurricane protection system which can be used for precluding damage to windows during high wind conditions. In this regard, the present invention substantially fulfills this need.

SUMMARY OF THE INVENTION

In view of the foregoing disadvantages inherent in the known types of window covering devices of known designs and configurations now present in the prior art, the present invention provides an improved hurricane protection system. As such, the general purpose of the present invention, which will be described subsequently in greater detail, is to provide a new and improved hurricane protection system and method which has all the advantages of the prior art and none of the disadvantages.

To attain this, the present invention essentially comprises a rectangular window. The window is oriented in an essentially vertical plane. The window has an inside and an outside. The window is supported by a peripheral sash. A wall in an essentially vertical plane is next provided. The wall has a rectangular opening. The opening is defined by a horizontal header surface above, a horizontal sill surface below and spaced vertical jamb side surfaces between the header surface and the sill surface. The surfaces support the sash and the window which is supported within the sash. Each of the surfaces is provided with at least one cylindrical hole to the outside of the window. The holes of the header surface are axially aligned with the holes of the sill surface. The holes of the jamb side surfaces are axially aligned. Next provided is a ridged wooden sheet in a rectangular configuration. The wooden sheet is positioned within the opening adjacent to, but spaced from, the sash and the window. The wooden sheet has an upper edge adjacent to the header surface and a lower edge adjacent to the sill surface. The wooden sheet also has parallel side edges adjacent to the jamb side surfaces. A plurality of fixed retention mechanisms are next provided. The retention mechanisms are secured to the sheet adjacent to the lower edge. Each fixed retention mechanism has a plate with apertures secured to the sheet. The preferred method of securement is by nuts and bolts. Each plate also has a downwardly extending finger. The finger has a lower end positioned in an associated hole of the sill surface. The finger also has an upper end secured to the plate beneath the apertures. The preferred method of securement is a weld. Next provided are a plurality of supplemental retention mechanisms. The supplemental retention mechanisms are secured to the sheet adjacent to the upper and side edges. Each of the supplemental retention mechanisms include a J-shaped finger with a short leg and a long leg terminating in a free end reciprocal between a locked orientation within an associated hole and unlocked orientation out of, but aligned with, an associated hole. Each of the supplemental retention mechanisms also includes a bracket with a central face attached to the sheet. The preferred method of attachment is by nuts and bolts. The bracket has an inboard plate and an outboard plate extending at right angles from the central plate. The inboard and outboard plates have aligned apertures aligned with an associated hole for the reciprocal support of the long leg. The long leg has projections at an intermediate extent. A coil spring positioned between the inboard plate and the projections urges the free end into an associated hole. The finger is adapted to be retracted from the hole against the urging of the spring and rotated whereby the short leg abuts the inboard plate to maintain the finger out its associated hole. Lastly, a pair of handles are provided. Each handle is formed in a generally C-shaped configuration. Interior ends of the handle are secured to the sheet at a central extent of the sheet. The preferred method of securement is by nuts and bolts. A central extent between the free ends and spaced from the sheet is provided for being grasped by a user during installation of the sheet and removal of the sheet.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hurricane protection system which has all of the advantages of the prior art window covering devices of known designs and configurations and none of the disadvantages.

It is another object of the present invention to provide a new and improved hurricane protection system which may be easily and efficiently manufactured and marketed.

It is further object of the present invention to provide a new and improved hurricane protection system which is of durable and reliable constructions.

An even further object of the present invention is to provide a new and improved hurricane protection system which is susceptible of a low cost of manufacture with regard to both materials and labor, and which accordingly is then susceptible of low prices of sale to the consuming public, thereby making such hurricane protection system economically available to the buying public.

Even still another object of the present invention is to provide a hurricane protection system for precluding damage to windows during high wind conditions.

Lastly, it is an object of the present invention to provide a new and improved hurricane protection system comprising a rigid sheet in a rectangular configuration positioned within a window opening with an upper edge, a lower edge, and parallel side edges. A plurality of fixed retention mechanisms are secured to the sheet adjacent to the lower edge. Each fixed retention mechanism has a plate secured to the sheet and a downwardly extending finger with a lower end positioned in an associated hole and an upper end secured to the plate. A plurality of supplemental retention mechanisms are secured to the sheet adjacent to the upper and side edges. Each of the supplemental retention mechanisms include a J-shaped finger with a short leg and a long leg terminating in a free end reciprocal between a locked orientation within an associated hole and unlocked orientation out of, but aligned with, an associated hole. Each of the supplemental retention mechanisms include a bracket with a central face attached to the sheet. An inboard plate and an outboard plate extend at right angles from the central plate. The inboard and outboard plates have aligned apertures aligned with an associated hole for the reciprocal support of the long leg. The long leg has projections at an intermediate extent with a coil spring between the inboard plate and the projections urging the free end into an associated hole. The finger is adapted to be retracted from the hole against the urging of the spring and rotated whereby the short leg abuts the inboard plate to maintain the finger out its associated hole.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
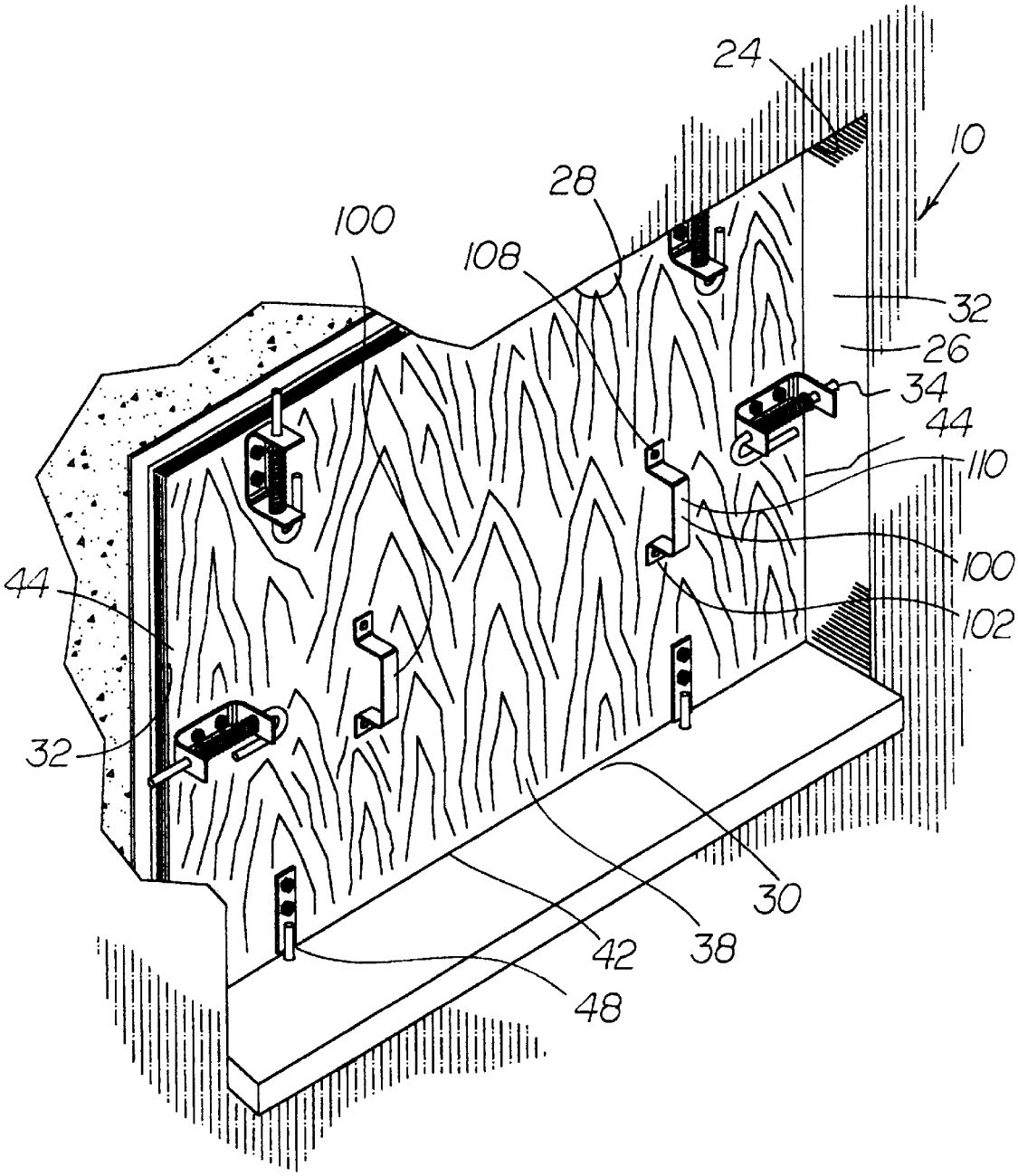
FIG. 1 is a perspective view of a hurricane protection system constructed in accordance with the principles of the present invention with one side and a portion of the top broken away to show certain internal constructions.
Figure 2:
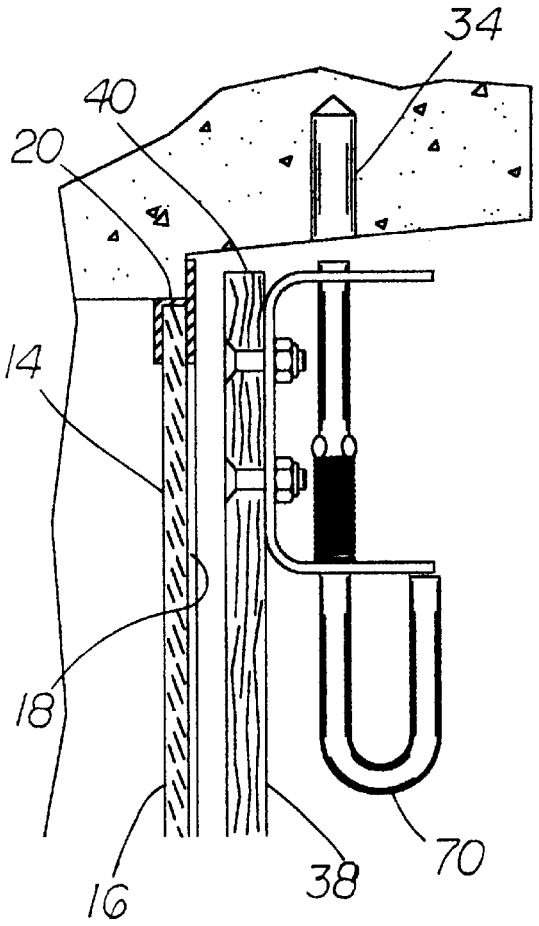
FIG. 2 is a cross-sectional view of one supplemental retention mechanism in a locked orientation.
Figure 3:
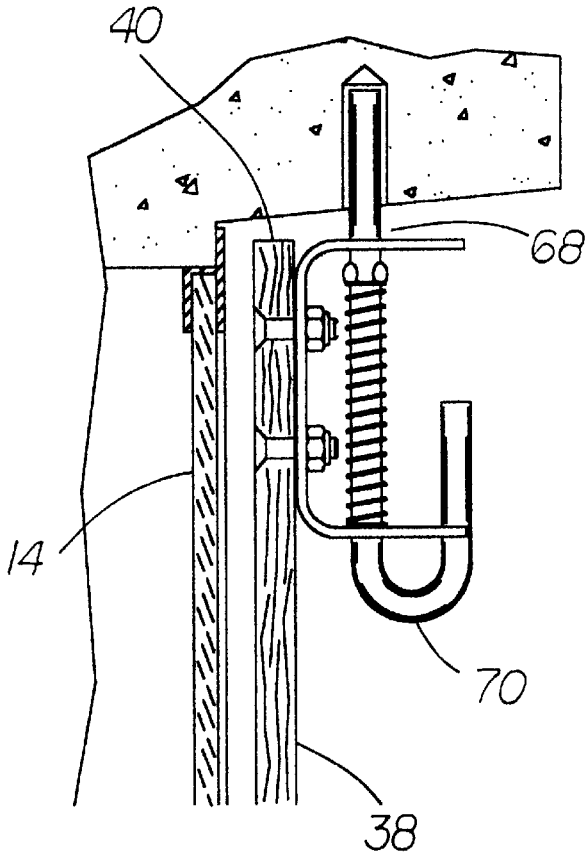
FIG. 3 is a cross-sectional view similar to FIG. 2 but in an unlocked orientation.
Figure 4:
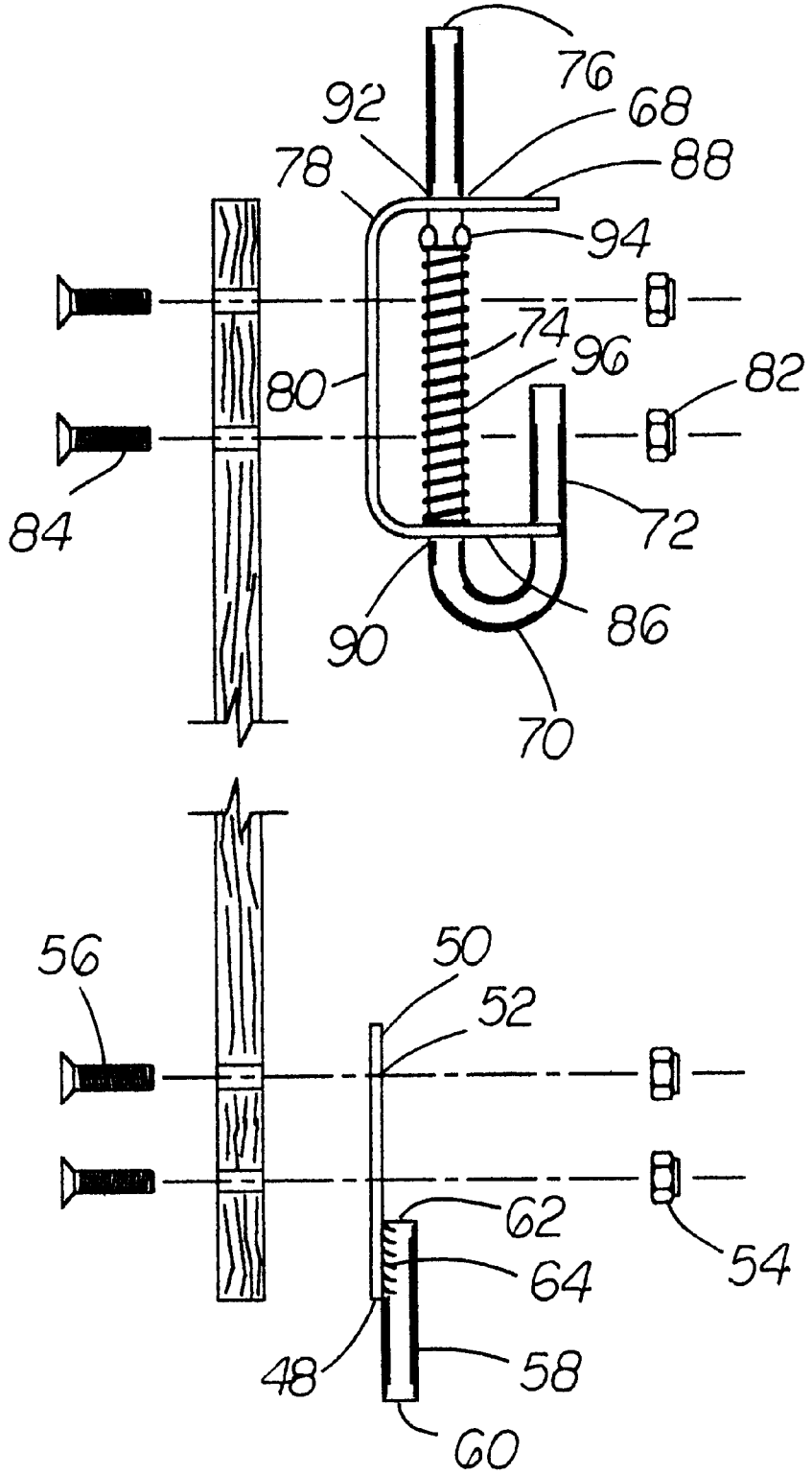
FIG. 4 is an exploded perspective view of one fixed retention mechanism and one fixed supplemental mechanism.

With reference now to the drawings, and in particular to FIG. 1 thereof, the preferred embodiment of the new and improved hurricane protection system embodying the principles and concepts of the present invention and generally designated by the reference numeral 10 will be described.

The present invention, the hurricane protection system 10 is comprised of a plurality of components. Such components in their broadest context include a ridged sheet, a plurality of fixed retention mechanisms, and a plurality of supplemental retention mechanisms. Such components are individually configured and correlated with respect to each other so as to attain the desired objective.

First provided is a rectangular window 14. The window is oriented in an essentially vertical plane. The window has an inside 16 and an outside 18. The window is supported by a peripheral sash 20.

A wall 24 in an essentially vertical plane is next provided. The wall has a rectangular opening 26. The opening is defined by a horizontal header surface 28 above, a horizontal sill surface 30 below and spaced vertical jamb side surfaces 32 between the header surface and the sill surface. The surfaces support the sash and the window which is supported within the sash. Each of the surfaces is provided with at least one cylindrical hole 34 to the outside of the window. The holes of the header surface are axially aligned with the holes of the sill surface. The holes of the jamb side surfaces are axially aligned.

Next provided is a ridged wooden sheet 38 in a rectangular configuration. The wooden sheet is positioned within the opening adjacent to, but spaced from, the sash and the window. The wooden sheet has an upper edge 40 adjacent to the header surface and a lower edge 42 adjacent to the sill surface. The wooden sheet also has parallel side edges 44 adjacent to the jamb side surfaces.

A plurality of fixed retention mechanisms 48 are next provided. The fixed retention mechanisms are secured to the sheet adjacent to the lower edge. Each fixed retention mechanism has a plate 50 with apertures 52 secured to the sheet. The preferred method of securement is by nuts 54 and bolts 56. Each plate also has a downwardly extending finger 58. The finger has a lower end 60 positioned in an associated hole of the sill surface. The finger also has an upper end 62 secured to the plate beneath the apertures. The preferred method of securement is a weld 64.

Next provided are a plurality of supplemental retention mechanisms 68. The supplemental retention mechanisms are secured to the sheet adjacent to the upper and side edges. Each of the supplemental retention mechanisms include a J-shaped finger 70 with a short leg 72 and a long leg 74 terminating in a free end 76 reciprocal between a locked orientation within an associated hole and unlocked orientation out of, but aligned with, an associated hole. Each of the supplemental retention mechanisms also includes a bracket 78 with a central face 80 attached to the sheet. The preferred method of attachment is by nuts 82 and bolts 84. The bracket has an inboard plate 86 and an outboard plate 88 extending at right angles from the central plate. The inboard and outboard plates have aligned apertures 90, 92 aligned with an associated hole for the reciprocal support of the long leg. The long leg has projections 94 at an intermediate extent. A coil spring 96 positioned between the inboard plate and the projections urges the free end into an associated hole. The finger is adapted to be retracted from the hole against the urging of the spring and rotated whereby the short leg abuts the inboard plate to maintain the finger out its associated hole.

Lastly, a pair of handles 100 are provided. Each handle is formed in a generally C-shaped configuration. Interior ends 102 of the handle are secured to the sheet at a central extent of the sheet. The preferred method of securement is by nuts 106 and bolts 108. A central extent 110 between the free ends and spaced from the sheet is provided for being grasped by a user during installation of the sheet and removal of the sheet.

The present invention functions for use as high wind and flying debris protection for windows in structures particularly those with recessed window casements, i.e. stucco over masonry constructed homes.

The present hurricane protection system is in a window cover kit which consists of: (a) standard ½" plywood sheathing, custom cut to size to fit each window (multiple covers with overlapping edges may be used to cover large windows); (b) unique J-shaped or cane-shaped spring loaded retaining rods with mounting brackets for quick engagement/disengagement into predrilled holes in top and sides of window casement and stationary retaining rods for engagement into predrilled holes in a window sill and with metal handles for assembly, the J-shaped or cane-shaped rods are mounted to top and sides of plywood covers, then the stationary rods are mounted to bottom of plywood covers, then the handles are mounted on covers, then the covers are lifted into place over appropriate windows, retaining rod locations are marked and drilled into window casements and sills, then finally, the window covers may now be installed or removed in a matter of minutes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hurricane protection system for precluding damage to windows during high wind conditions comprising, in combination:

a rectangular window oriented in an essentially vertical plane with an inside and an outside, the window being supported by a peripheral sash;

a wall in an essentially vertical plane having a rectangular opening defined by a horizontal header surface above, a horizontal sill surface below and spaced vertical jamb side surfaces there between, the surfaces supporting the sash and the window there within, each of the surfaces having at least one cylindrical hole to the outside of the window with the holes of the header surface being axially aligned with the holes of the sill surface and the holes of the jamb side surfaces being axially aligned;

a ridged wooden sheet in a rectangular configuration positioned within the opening adjacent to but spaced from the sash and the window with an upper edge adjacent to the header surface, a lower edge adjacent to the sill surface and parallel side edges adjacent to the jamb side surfaces;

a plurality of fixed retention mechanisms secured to the sheet adjacent to the lower edge, each fixed retention mechanism having a plate with apertures secured to the sheet, preferably by nuts and bolts, and with a downwardly extending finger with a lower end positioned in an associated hole of the sill surface and an upper end beneath the apertures secured to the plate by a weld;

a plurality of supplemental retention mechanisms secured to the sheet adjacent to the upper and side edges, each of the supplemental retention mechanisms including a J-shaped finger with a short leg and a long leg terminating in a free end reciprocal between a locked orientation within an associated hole and unlocked orientation out of, but aligned with, an associated hole, each of the supplemental retention mechanisms including a bracket with a central face attached to the sheet by nuts and bolts, and with an inboard plate and an outboard plate extending at right angles from the central plate, the inboard and outboard plates having aligned apertures aligned with an associated hole for the reciprocal support of the long leg, the long leg having projections at an intermediate extent with a coil spring between the inboard plate and the projections urging the free end into an associated hole, the finger adapted to be retracted from the hole against the urging of the spring and rotated whereby the short leg abuts the inboard plate to maintain the finger out its associated hole;

a pair of handles, each in a generally C-shaped configuration with interior ends secured to the sheet at a central extent thereof by nuts and bolts, and a central extent between the free ends and spaced from the sheet for being grasped by a user during installation of the sheet and its removal.

* * * * *